US007575521B2

(12) United States Patent
Recknagel

(10) Patent No.: US 7,575,521 B2
(45) Date of Patent: Aug. 18, 2009

(54) BOWLING BUMPER SYSTEM WITH LOWERED LEADING EDGE

(75) Inventor: Troy A. Recknagel, Muskegon, MI (US)

(73) Assignee: Brunswick Bowling & Billiards Corporation, Lake Forest, IL (US)

( * ) Notice: Subject to any disclaimer, the term of this patent is extended or adjusted under 35 U.S.C. 154(b) by 213 days.

(21) Appl. No.: 11/717,255

(22) Filed: Mar. 12, 2007

(65) Prior Publication Data

US 2008/0227558 A1 Sep. 18, 2008

(51) Int. Cl.
*A63D 5/00* (2006.01)

(52) U.S. Cl. ..... 473/113

(58) Field of Classification Search ..... 473/113, 473/115

See application file for complete search history.

(56) References Cited

U.S. PATENT DOCUMENTS

| | | | | | |
|---|---|---|---|---|---|
| 1,021,788 | A * | 4/1912 | Mutter | 473/116 |
| 4,900,024 | A | 2/1990 | Chandler et al. | 273/37 |
| 5,181,716 | A | 1/1993 | Stephens | 273/51 |
| 5,207,422 | A | 5/1993 | Beene | 273/37 |
| 5,304,097 | A | 4/1994 | Duff | 473/113 |
| 5,322,476 | A | 6/1994 | Wortman | 473/113 |
| 5,380,251 | A * | 1/1995 | Heddon | 473/109 |
| 5,405,295 | A * | 4/1995 | Lord | 473/55 |
| 5,415,591 | A | 5/1995 | Beene | 473/113 |
| 5,417,616 | A | 5/1995 | Widrick | 473/113 |
| 5,435,788 | A | 7/1995 | Duff | 473/113 |
| 5,449,326 | A | 9/1995 | File | 473/55 |
| RE35,232 | E | 5/1996 | Stephens | 473/55 |
| 5,564,986 | A | 10/1996 | Gretzky et al. | 273/113 |
| 5,584,766 | A | 12/1996 | File | 473/54 |
| 5,681,224 | A | 10/1997 | Higashi | 473/109 |
| 5,800,275 | A | 9/1998 | Gretzky et al. | 473/113 |
| 5,857,918 | A * | 1/1999 | Beene | 473/55 |
| 6,402,629 | B1 * | 6/2002 | Heddon | 473/55 |
| 6,988,953 | B2 * | 1/2006 | Kuoppa et al. | 473/113 |
| 7,052,404 | B2 | 5/2006 | Heddon | 473/113 |
| 7,070,510 | B2 * | 7/2006 | Heddon | 473/55 |

OTHER PUBLICATIONS

"Pinball Wizard™," Brunswick, 2 pages (1999).

"Pinball Wizard™ Operations and Service Manual," Brunswick, 45 pages (2001).

(Continued)

*Primary Examiner*—William M Pierce
(74) *Attorney, Agent, or Firm*—Brinks Hofer Gilson & Lione

(57) ABSTRACT

A bowling bumper system is disclosed comprising a bumper rail and a positioning system configured to move the bumper rail between a first position below a bowling lane surface and a second position above the bowling lane surface. When the bumper rail is in the second position, an end portion of the bumper rail near a foul line of the bowling lane extends toward the bowling lane surface. In another embodiment, a bowling bumper system is disclosed comprising a bumper and a positioning system configured to move the bumper between a first position below a bowling lane surface and a second position above the bowling lane surface. The positioning system comprises a plurality of pivotable links, wherein a pivotable link closest to a foul line of the bowling lane is shorter than at least one of the other pivotable links.

18 Claims, 5 Drawing Sheets

OTHER PUBLICATIONS

"Lane Systems," Brunswick, 8 pages (2005).
"Center Enhancements," Brunswick, 4 pages (2006).
"Introducing Bankshot™," DBA, 2 pages (2003).
"Q-Bump XS Excessive Bottom-Line Bounce," 2 pages (2005).
"Durabowl Bumpers and Gutters," QuibicaAMF, 1 page (2005).

* cited by examiner

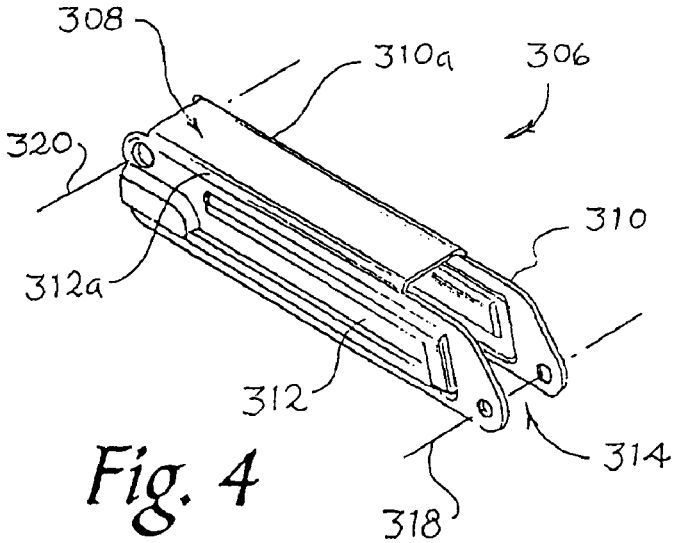
Fig. 4
Fig. 5
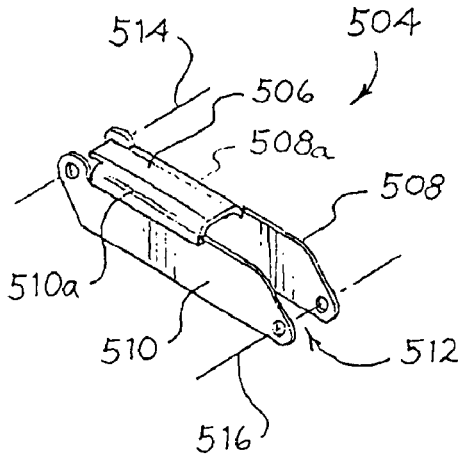
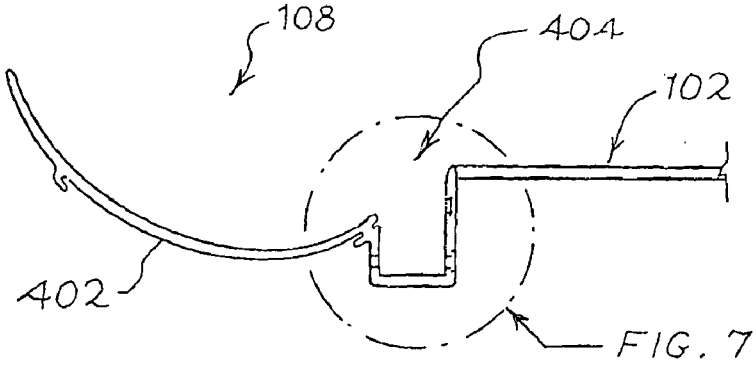
Fig. 6
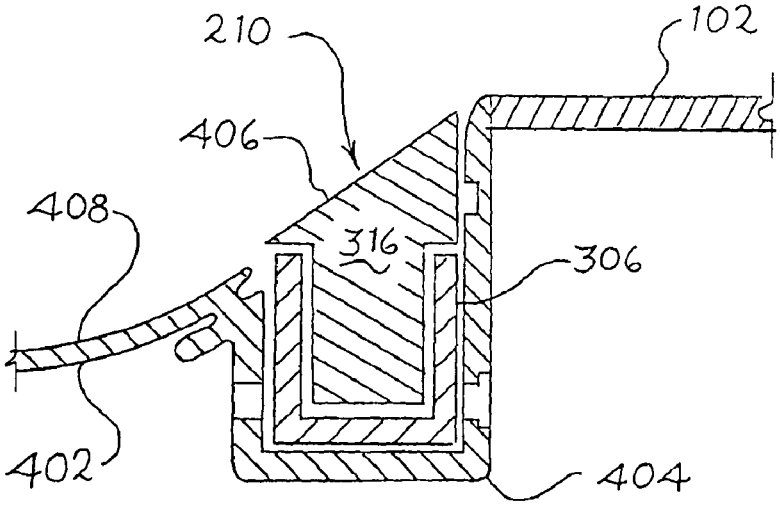
Fig. 7

BOWLING BUMPER SYSTEM WITH LOWERED LEADING EDGE

BACKGROUND

Children and other bowlers who have little control over a bowling ball can become frustrated if their attempts to knock down bowling pins frequently result in the bowling ball rolling into a gutter rather than striking bowling pins. Bowling bumper rails have been used to prevent a bowling ball from falling off a bowling lane and into a gutter. Such rails are retractably positioned above the bowling lane surface near the gutter to contain the bowling ball on the bowling lane. While bowling bumper rails are designed and constructed to withstand repeated lateral impacts, a problem can occur if the bowling ball is thrown straight into the end of the bowling bumper rail. In such a situation, all of the energy from the bowling ball transfers through the bowling bumper rail, potentially causing damage to the bowling bumper rail, its positioning system, and/or its actuator system.

SUMMARY

The present invention is defined by the claims, and nothing in this section should be taken as a limitation on those claims.

By way of introduction, in one embodiment described below, a bowling bumper system is presented comprising a bumper rail and a positioning system configured to move the bumper rail between a first position below a bowling lane surface and a second position above the bowling lane surface. When the bumper rail is in the second position, an end portion of the bumper rail near a foul line of the bowling lane extends toward the bowling lane surface. In another embodiment, a bowling bumper system is presented comprising a bumper and a positioning system configured to move the bumper between a first position below a bowling lane surface and a second position above the bowling lane surface. The positioning system comprises a plurality of pivotable links, wherein a pivotable link closest to a foul line of the bowling lane is shorter than at least one of the other pivotable links. Other embodiments are disclosed, and each of the embodiments can be used alone or together in combination.

BRIEF DESCRIPTION OF THE FIGURES

FIG. 4 is an illustration of a pivot link of an embodiment.

FIG. 5 is an illustration of a leading edge pivot link of an embodiment.

FIGS. 6 and 7 are illustrations of a bowling lane with a bumper system that cooperates with a gutter.

DETAILED DESCRIPTION

Figure 1:
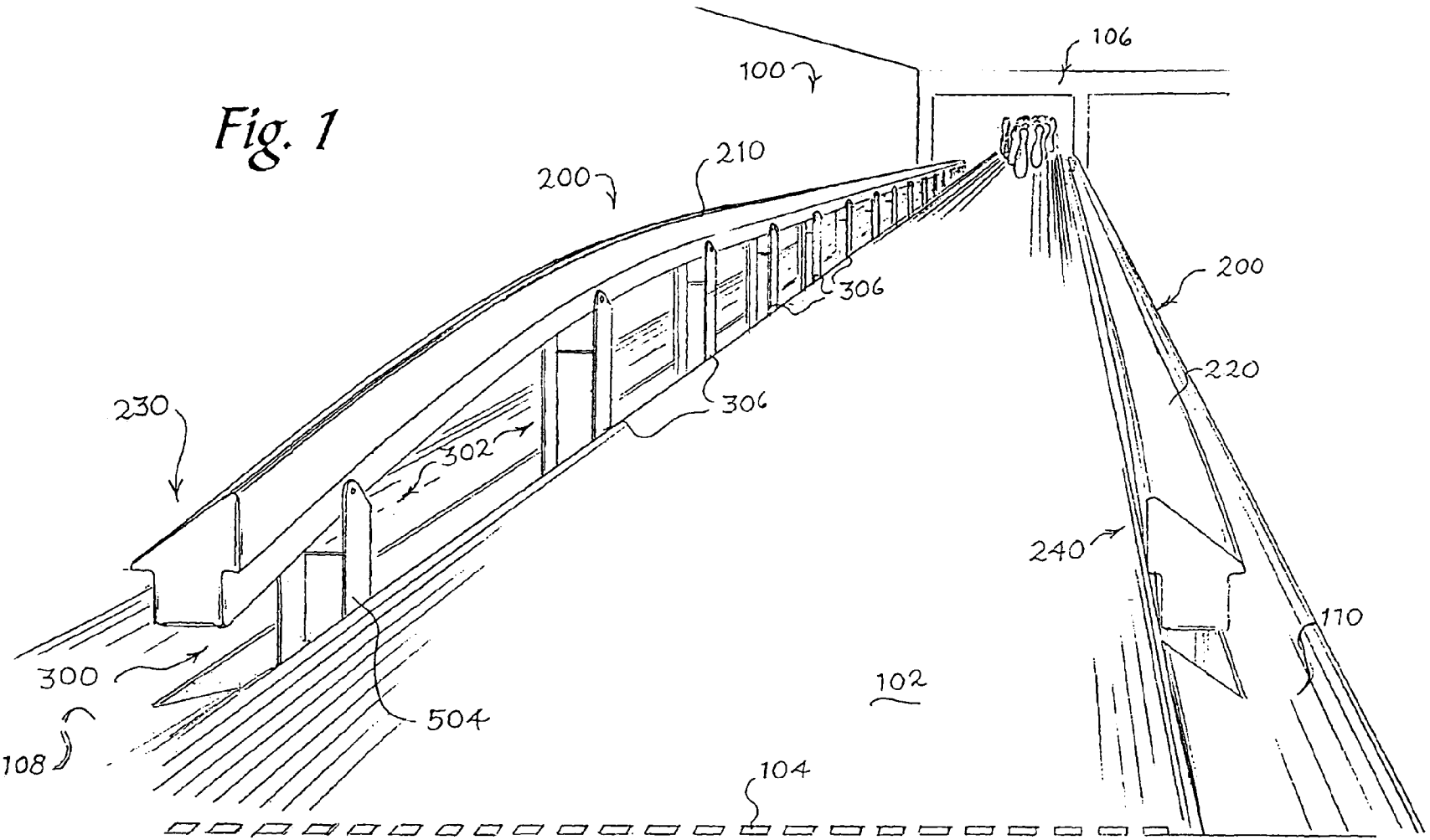
FIG. 1 is an illustration of a bowling lane with a bumper system of an embodiment.
Figure 2:
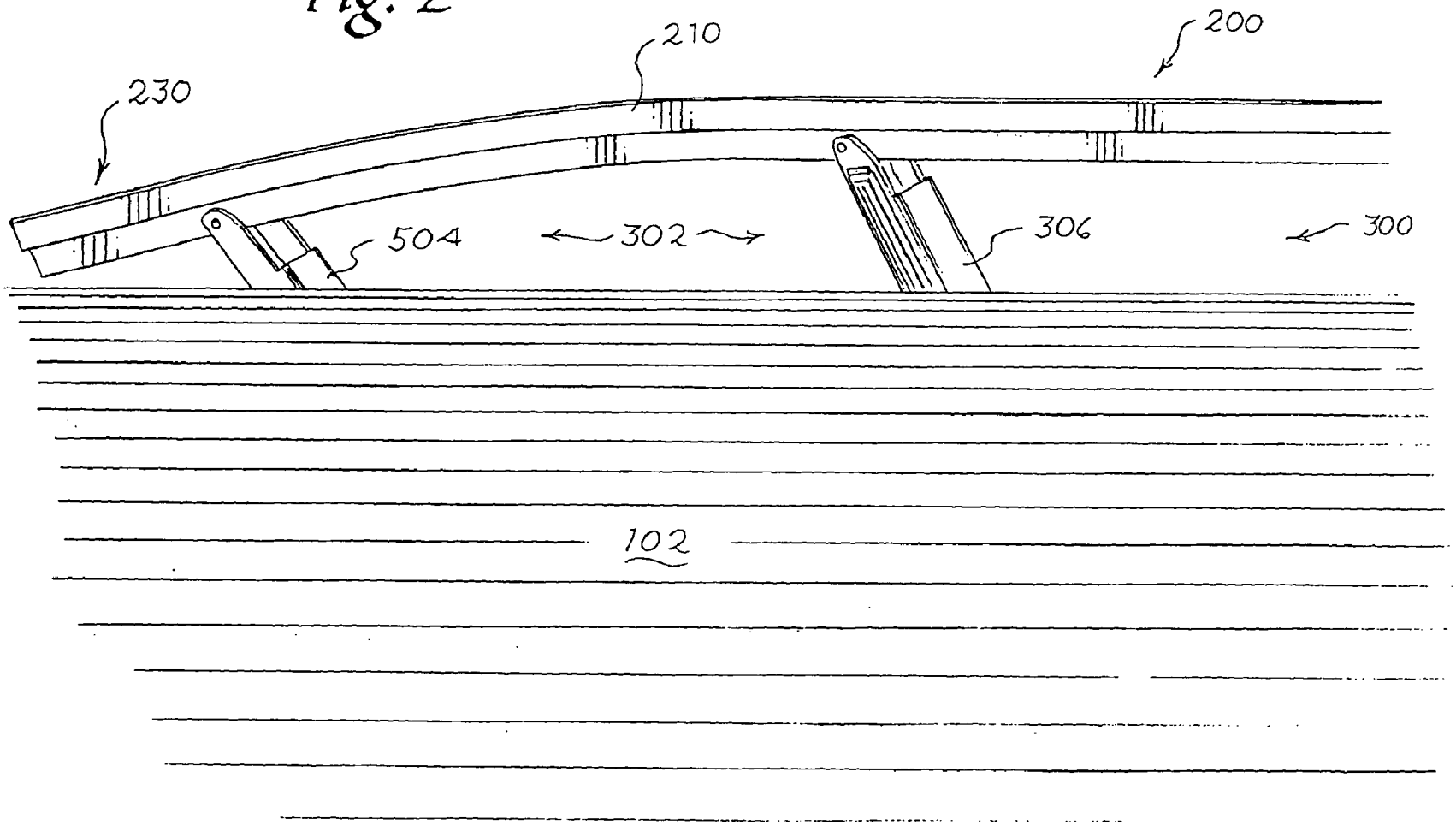
FIG. 2 is a side view of part of the bowling lane of FIG. 1.

Turning now to the drawings, FIG. 1 is an illustration of a bowling lane 100 with a bumper system 200 of an embodiment, and FIG. 2 is a side view of part of the bowling lane 100. As shown in these drawings, the bowling lane 100 comprises a bowling lane surface 102 extending between a foul line 104 and a pin area 106. The bowling lane 100 further includes a pair of gutters 108, 110 positioned along each edge of the bowling lane surface 102. The gutters 108, 110 are sized and arranged to direct thrown bowling balls that leave the bowling lane surface 102 towards a ball return mechanism disposed at or near the pin area 106 of the bowling lane 100.

The bowling lane 100 also comprises a bowling bumper system 200, which may be installed when the bowling lane 100 is installed or during an upgrade or retrofit of the bowling lane 100. In this embodiment, the bowling bumper system 200 comprises a pair of bumpers (here, a pair of bumper rails 210, 220) positioned between the bowling lane surface 102 and the gutters 108, 110 and longitudinally along the bowling lane 100 between the foul line 104 and the pin area 106. The bumper rails 210, 220 deflect bowling balls thrown laterally towards the gutters 108, 110.

As mentioned above, in this embodiment, the bumpers take the form of bumper rails. As used herein, a "bumper rail" refers to an object that is relatively more rigid and relatively less stretchable than a cord, such as a bungee cord. In this way, a bumper rail more positively resists deformation than a cord and better redirects the impact of a thrown bowling ball, in contrast to a cord, which simply absorbs energy imparted by a thrown bowling ball and deforms in response thereto. A bumper rail can be made from any suitable material, including, but not limited to, plastic, polyvinyl chloride (PVC), steel, and aluminum. As discussed below, in other embodiments, a bumper can take forms other than a bumper rail.

Unlike prior bumper rail systems, each bumper rail 210, 220 comprises an end portion 230, 240 near the foul line 104 that extends toward the bowling lane surface 102. End portions of prior bumper rail systems are in the same plane as the rest of the bumper rails. Accordingly, if a bowling ball is thrown straight into the end portion of a prior bumper rail system, all of the energy from the bowling ball transfers through the bowling bumper rail, potentially causing damage to the bowling bumper rail, its positioning system, and/or its actuator system. In contrast, lowering the front end portion 230, 240 of the bowling rail 210, 220 increases the durability of the bumper system 300. Specifically, if a bowling ball is thrown straight into the lower front end portion 230, 240, the bowling ball is allowed to deflect up or to the side, which greatly reduces the amount of impact energy transferred from the bowling ball to the bumper rail 210, 220, thus reducing or eliminating damage to the bumper system 300.

Figure 3:
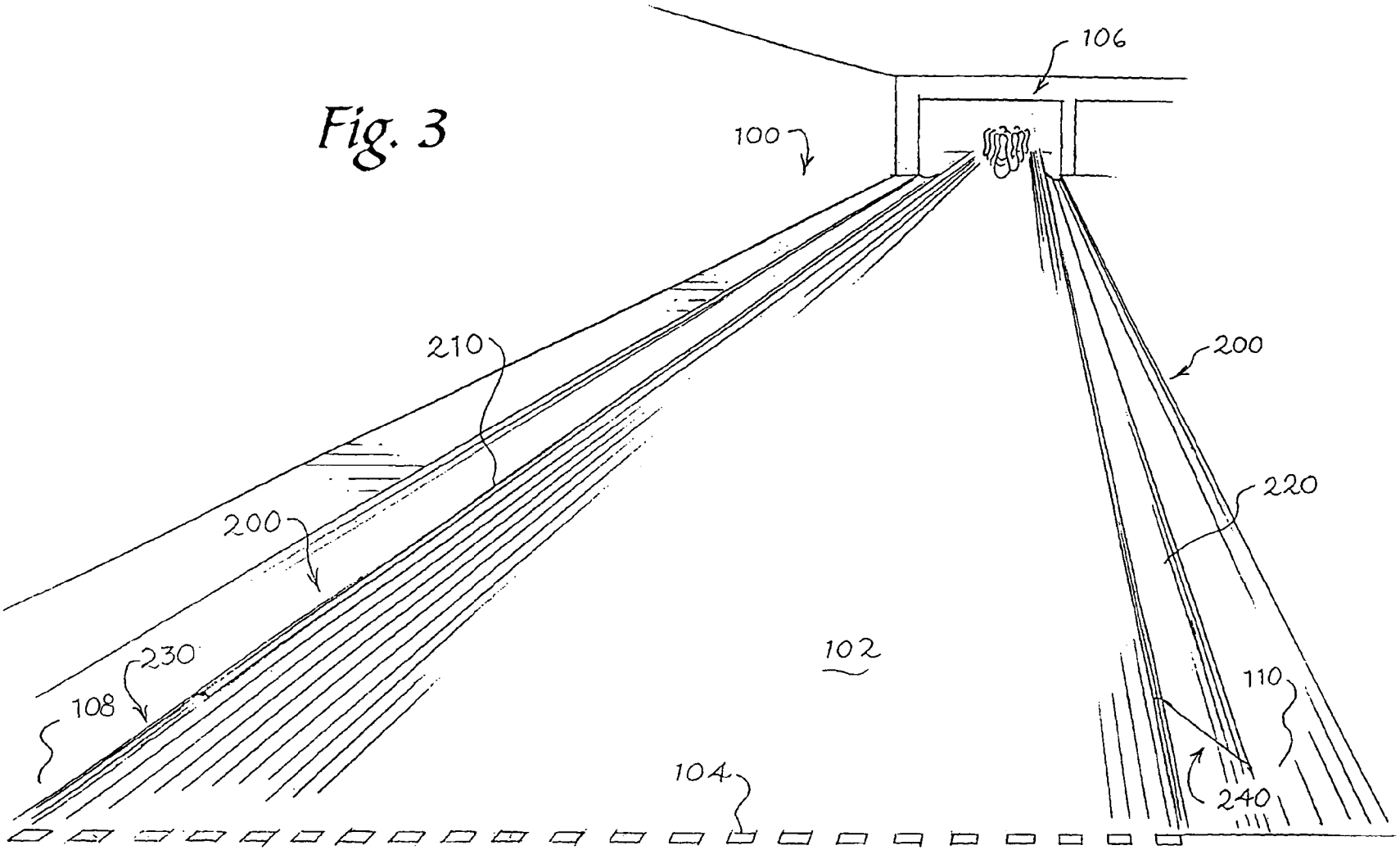
FIG. 3 is an illustration of a bowling lane with a bumper system of an embodiment in a first position.

In this embodiment, the bumper system 200 also includes a positioning system 300 that is configured to move the bumper rails 210, 220 between a first position below the bowling lane surface 102 (see FIG. 3) and a second position above the bowling lane surface 102 (see FIGS. 1 and 2). As used herein, a bumper rail is "below the bowling lane surface" when its top surface is flush with or below the bowling lane surface 102, such that the bumper rail does not interfere with a bowling ball rolling from the bowling lane surface 102 into one of the gutters 108, 110. In this embodiment, when the bumper rails 210, 220 are in the second position, the end portions 230, 240 extends toward the bowling lane surface 102 (see FIGS. 1 and 2); while, when in the first position, the end portions 230, 240 are co-planar with the other portions of the bumper rails 210, 220 (see FIG. 3).

Although the bumper rails 210, 220 can be grabbed and moved between the first and second positions, the positioning system 300 can be connected to a lever or a motor for manually or automatically causing the positioning system 300 to move the bumper rails 210, 220 between the first and second positions. Pinball Wizard™ by Brunswick Bowling and Billiards Corporation is an example of an automatic bumper rail movement system that can be modified to be used with these embodiments.

The following is a description of a presently preferred positioning system. It should be noted, however, than any appropriate positioning system can be used. Accordingly, the following details should not be read into the claims unless expressly recited therein. In this embodiment, the positioning system 300 comprises a plurality of pivot links 302 that are rotatably coupled to the bumper rails 210, 220. As used herein, the phrase "coupled to" means directly coupled to or indirectly coupled to through one or more components, named or unnamed herein. In this embodiment, the plurality of pivot links 302 includes same-size pivot links 306 and a leading edge pivot link 504. Although there is only one leading edge pivot link 504 per bumper rail 210, 220 in this embodiment, in other embodiments, a plurality of leading edge pivot links per bumper rail are used.

As shown in FIG. 4, each of the same-size pivot links 306 comprises a substantially u-shaped cross-section, which can be formed by the cooperation of a back wall 308 coupled to a pair of side walls 310, 312. The side walls 310, 312, in turn, can be bent or folded along seams 310*a*, 312*a*, respectively, to form a channel 314. The channel 314 may be sized to accept the bumper rails 210, 220. Each of the same-size pivot links 306 can be secured adjacent to the gutters 108, 110 and configured to allow rotation about a fixed rotation axis 320. The unsecured end of the first pivot links 306 may be attached or coupled to the bumper rails 210, 220 about a translatable rotation axis 318. The axes 318 and 320 may be formed and disposed approximately six (6) inches (15.2 centimeters) from each other. Thus, upon activation, each of the first pivot links 306 may move through an approximately six-inch arc while carrying the bumper rail 210, 220 between the first and second positions.

The leading edge pivot link 504, similar to the same-size pivot link 306, is rotatably coupled to the front end portion 230 of the bowling rail 210. As shown in FIG. 5, the leading edge pivot link 504 can comprise a u-shaped cross-section defined by the cooperation of a back wall 506 coupled to a pair of side walls 508, 510. The side walls 508, 510 may be bent or folded along seams 508*a*, 510*a*, respectively. The u-shape of the leading edge pivot link 504 may form a channel 512 that allows the end portion 230 to cooperatively nest therein. As discussed below in conjunction with FIG. 7, the end portion 500 and the leading edge pivot link 504 may, in turn, rest within a bumper channel 404 in the first position.

In this embodiment, the leading edge pivot link 504 is manufactured to be linearly smaller or shorter than the same-size pivot links 306. Specifically, the rotation axis of each of the same-size pivot links 306 may be separated by approximately six inches, while the fixed rotation axis 514 and the translatable rotation axis 516 of the leading edge pivot link 504 may be separated by approximately 4.875 inches. Given this difference in sizes, it is preferred that the mounting hole in the gutter 108 be moved by 1⅛ inches, so that, when the bumper rail 210, 220 is in the down position, the plurality of links 300 are all roughly horizontal. Alternatively, the same pin location in the gutter 108 can be used, and the pin location in the bumper rail 210, 220 can be moved by 1⅛ inches.

Due to the shorter size of the leading edge pivot link 504, the movement and translation of the leading edge pivot link 504 positions or drives the end portion 230 to extend toward the bowling lane surface 102. Specifically, as the positioning system 300 moves the bumper rail 210 to the second position, the shorter leading edge pivot link 504 rotates about the fixed rotation axis 514 secured adjacent to the gutter 108. The movement about the rotation axis 514, in turn, causes the opposite end of the leading edge pivot link 504, which is attached to the end portion 230 at the rotation axis 516, to transcribe an arc which is smaller than the one transcribed by each of the pivot links 306. Because the shorter leading edge pivot link 504 rotates at an angle greater than that of the same-size links 306, the leading edge pivot link 504 is no longer parallel to the same-size pivot links 306. The rotation and movement of the leading edge pivot link 500 in this manner pulls or deflects the end portion 230 into an arc toward the bowling lane surface 102, such that the bottom of the lowered end portion 230 is approximately two inches above the bowling lane surface 102). In contrast to a bumper rail of an undeflected height of about 4¼ inches high, when a bowling ball hits the lowered end portion 230, the bowling ball does not stop immediately, bounce back, or change directions, but rather bounces up or to the side of the bumper rail 210, 220, continuing to move in the direction thrown. This results in much less load transferring into the end of the bumper rail 210, 220.

Although the bumper rails 210, 220 can have any desired shape, in this embodiment, the bumper rails 210, 220 defines a roughly triangular-shaped cross-section 316 (see FIG. 7) sized to engage and cooperate with the channels of the plurality of pivot links 300. For example, when the bumper rails 210, 220 are disposed adjacent to the bowling lane surface 102, the appropriately-sized cross-section of the bumper rails 210, 220 can be carried within the channel 314 of the same-size pivot links 306 and the channel 512 of the leading edge pivot link 504. In this position, the bumper rails 210, 220 and each of the pivot links 300 lay horizontally and are aligned substantially parallel to the bowling lane surface 102. When the positioning system 300 moves the bumper rails 210, 220 to the second position, the same-size pivot links 306 rotate about the axis 320 carrying and translating the coupled bumper rails 210, 220, secured at the axis 318, to the second position. In the second position, the same-size pivot links 306 are aligned perpendicular to the bowling lane surface 102. The cooperation of the pivot links 306 and the bumper rails 210, 220 provide lateral structural support allowing the bumper system 200 to deflect balls thrown towards the gutter 108.

As shown in FIG. 6, in this embodiment, the gutter 108 is designed to have a curved portion 402 and a bumper rail channel 404, which is sized to cooperate with and carry the bumper system 300. FIG. 7 illustrates the bumper channel 404 shown in the call-out of FIG. 6, cooperating with the bumper rail 210 and the pivot link 306. In particular, the bumper channel 404 supports and encloses the pivot link 306 and the bumper rails 210 (disposed within the channel 314) when the bumper system 200 is in the first position. As previously discussed, the cross-section 316 can be carried within the channel 314 to allow the bumper system 200 to collapse and be stored within the bumper channel 404. When the bumper system 200 is stored or resting in the first position, a surface 406 of the bumper rails 210, 220 may align substantially contiguously with a surface 408 of the curved portion 402, thereby forming part of the gutter 108. Of course, other configurations can be used, such as ones in which the collapsed bumper system 200 rests in another portion of the gutter 108 or outside of the gutter 108.

There are many alternatives that can be used with these embodiments. For example, in the above example, the end portion 230 was integral with and made from the same material as the bumper rail 210 and was flexed downwardly by bending the end portion 230 using a shorter pivot link 504. In an alternate embodiment, the end portion is still integral with the bumper rail but is made from a different material (e.g., a more flexible material) than the rest of the bumper rail. In yet another embodiment, instead of being integral with the bumper rail, the end portion is a separate component that is movably coupled to the bumper rail at a pivot point. (Accordingly, the terms "bumper" and "bumper rail" should not be read as requiring a single component or multiple components unless expressly recited in the claims.) Also, while the end portion 230 was shown as being supported above the bowling lane surface 102 even in the second position, in another alternate embodiment, the end portion freely hangs and moves along a slot (e.g., in the gutter or an area between the gutter and the bowling lane surface).

In the above examples, the bumper took the form of a bumper rail. As noted above, bumpers other than a bumper rail can be used with these embodiments. Examples of other non-bumper-rail bumpers include, but are not limited to, cords or bungee cords, as described in U.S. Pat. No. 5,380,251, and curtains, as described in U.S. Pat. No. 5,800,275. Further, as also noted above, positioning systems other than the positioning system 300 described above can be used. Examples of other types of positioning systems include, but are not limited to those described in U.S. Pat. Nos. 7,070,510; 7,052,404; 5,435,788; 5,181,716; 5,857,918; 5,681,224; 5,415,591; 5,405,295; 5,304,097; 4,900,024; 6,402,629; and 5,417,616.

Figure 8:
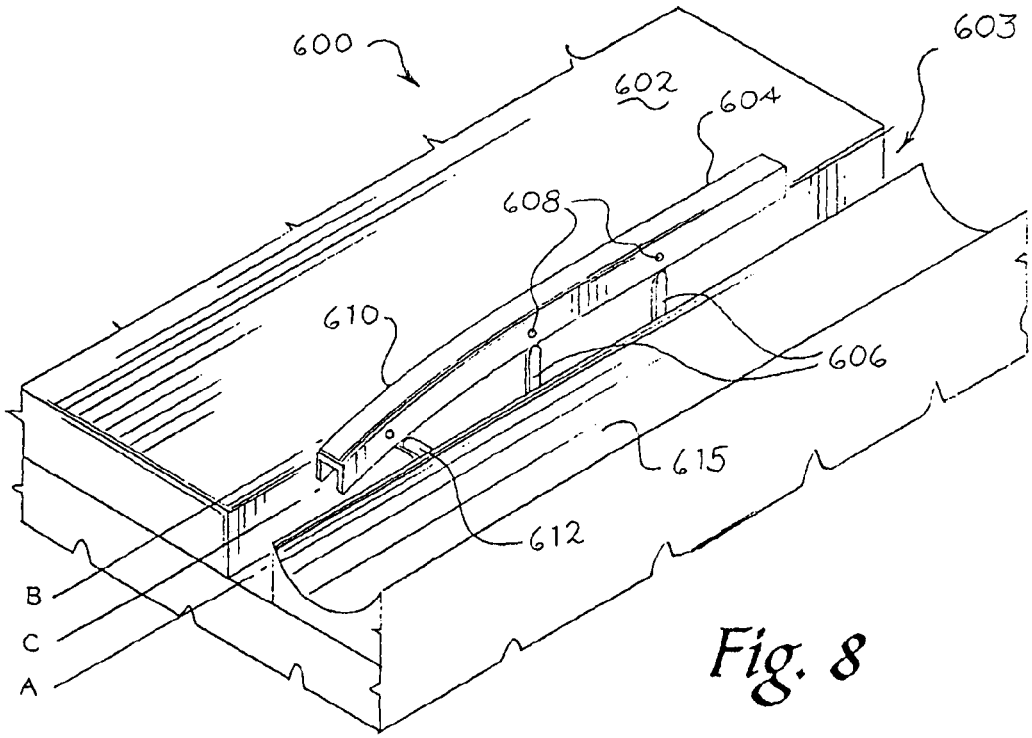
FIG. 8 is an illustration of a bowling lane with a bumper system of another embodiment.

It should be noted that existing bumper systems can be modified for use with these embodiments. For example, FIG. 8 shows how the bumper system described in U.S. Pat. No. 6,402,629 can be modified for use with these embodiments. As shown in FIG. 8, the bumper system 600 may be installed between the bowling lane surface 602 and the gutter 615 in a dedicated bumper slot or channel 603 (instead of being part of the gutter, as in the above embodiment). A u-shaped rail 604 may cooperate with pivot or lifting arms 606 rotatably secured at pivot points 608. A leading edge 610 may be rotatably coupled to leading edge lifting arm 612. In operation, the lifting arms 606 move the u-shaped rail 604 from position A to position B above the bowling lane surface 102. Simultaneously, the leading edge lifting arm 612 moves the leading edge 610 to a lower position C. In this way, the leading edge 610 creates or defines a ramp to deflect or otherwise guide bowling balls that may be thrown directly at the bumper rail 604.

Figure 9:
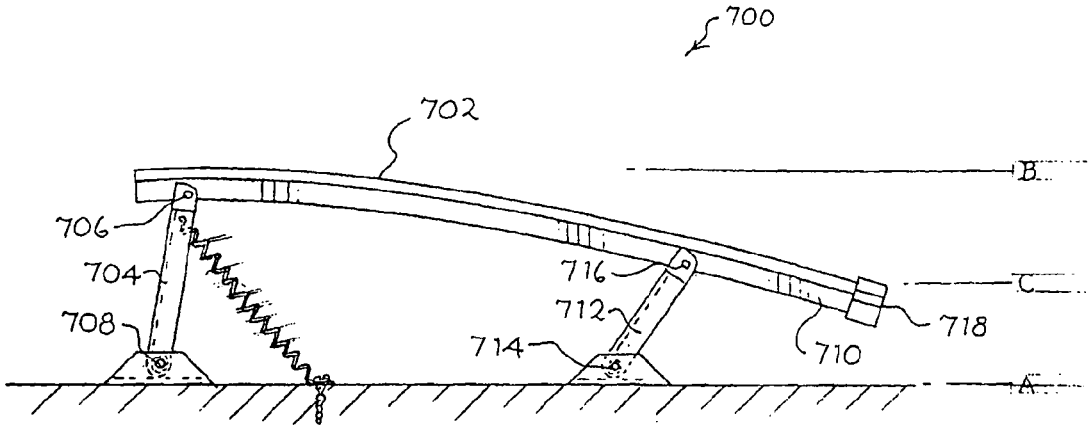
FIG. 9 is an illustration of a bowling lane with a bumper system of another embodiment.

As another example, FIG. 9 shows how the bumper system described in U.S. Pat. No. 5,417,616 can be modified for use with these embodiments. As shown in FIG. 9, the bumper system 700 includes longitudinally flexible rail 702 configured to cooperate with a lifting arm 704 rotatably secured between pivot point 706 and 708. A leading edge portion 710 of the flexible rail 702 is coupled to a leading edge lifting arm 712 between pivot point 714 and 716. In operation, the lifting arm 704 moves the flexible rail 702 from position A to position B. Simultaneously, the leading edge lifting arm 712 bends and flexes the leading edge 710 to a lower position C. In this way, the leading edge 710 creates or defines a ramp to deflect or otherwise guide bowling balls (not shown) that may be thrown directly at the bumper rail 702.

In another alternate embodiment, a first end 718 of the flexible rail 702 may carry a pin (not shown) configured to slidably traverse within a slot (not shown) disposed substantially parallel and adjacent to position A. In operation, as the flexible rail 702 moves toward position B, the pinned first end 718 is contained and slides within the slot (not shown). Because the first end 718 is trapped or contained within the slot (not shown), the flexible rail 702 bends to define a ramp which may, in turn defect thrown bowling balls. In this embodiment, the leading ledge lifting arm 712 may be unnecessary. In yet another embodiment, the end portion of a bumper or bumper rail can be secured rather than free to move.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A bowling bumper system comprising:

a bumper rail, wherein the bumper rail is relatively more rigid and relatively less stretchable than a cord; and a positioning system configured to move the bumper rail between a first position below a bowling lane surface and a second position above the bowling lane surface;

wherein, when the bumper rail is in the second position, an end portion of the bumper rail near a foul line of the bowling lane extends toward the bowling lane surface such that top and bottom surfaces of the end portion are non-parallel with respective top and bottom surfaces of the rest of the bumper rail.

2. The bowling bumper system of claim 1, wherein the positioning system comprises a plurality of pivotable links, and wherein a pivotable link closest to the foul line is shorter than at least one of the other pivotable links, whereby, when the positioning system moves the bumper rail to the second position, the pivotable link closest to the foul line pulls the end portion of the bumper rail toward the bowling lane surface.

3. The bowling bumper system of claim 1, wherein the bumper rail comprises a material selected from the group consisting of: plastic, polyvinyl chloride, steel, and aluminum.

4. The bumper system of claim 1, wherein the bumper rail is shaped to form part of a gutter adjacent the bowling lane surface when the bumper rail is in the first position.

5. The bumper system of claim 1, wherein the end portion of the bumper rail near the foul line is secured.

6. The bumper system of claim 1, wherein the end portion of the bumper rail near the foul line is free to move along a slot.

7. The bumper system of claim 1, wherein the end portion is integral with the bumper rail.

8. The bumper system of claim 1, wherein the end portion is separate from and movably coupled to the bumper rail at a pivot point.

9. A bowling bumper system comprising:

a bumper; and a positioning system configured to move the bumper between a first position below a bowling lane surface and a second position above the bowling lane surface, wherein the positioning system comprises a plurality of pivotable links, and wherein a pivotable link closest to a foul line of the bowling lane is shorter than at least one of the other pivotable links, whereby, when the positioning system moves the bumper to the second position, the pivotable link closest to the foul line pulls the end portion of the bumper toward the bowling lane surface.

10. The bowling bumper system of claim 9, wherein the bumper comprises a bumper rail.

11. The bowling bumper system of claim 9, wherein the bumper comprises a cord.

12. The bowling bumper system of claim 9, wherein the bumper comprises a material selected from the group consisting of: plastic, polyvinyl chloride, steel, and aluminum.

13. The bumper system of claim 9, wherein the bumper is shaped to form part of a gutter adjacent the bowling lane surface when the bumper is in the first position.

14. The bumper system of claim 9, wherein the end portion of the bumper near the foul line is secured.

15. The bumper system of claim 9, wherein the end portion of the bumper near the foul line is free to move along a slot.

16. The bumper system of claim 9, wherein the end portion is integral with the bumper.

17. The bumper system of claim 9, wherein the end portion is separate from and movably coupled to the bumper at a pivot point.

18. The bowling bumper system of claim 9, wherein the pivotable link closest to the foul line rotates at a different angle than an angle rotated by the other pivotable links and thereby pulls the end portion of the bumper toward the bowling lane surface.

* * * * *